United States Patent [19]

Nishikawa

[11] 4,250,620

[45] Feb. 17, 1981

[54] PLASTIC SCISSORS WITH METALLIC CUTTING INSERTS

[76] Inventor: Masatoshi Nishikawa, No. 56,, Aza-Ohira, Sanjoh, Bisai City, Aichi Prefecture,, Japan

[21] Appl. No.: 26,700

[22] Filed: Apr. 3, 1979

[30] Foreign Application Priority Data

Nov. 2, 1978 [JP] Japan ..... 53-135352

[51] Int. Cl.[3] ..... B26B 13/02

[52] U.S. Cl. ..... 30/254; 76/104 A

[58] Field of Search ..... 76/104 A; 30/254, 194, 30/341, 244, 252, 266

[56] References Cited

U.S. PATENT DOCUMENTS

| | | | |
|---|---|---|---|
| 1,609,638 | 2/1926 | Zeidler | 76/104 A |
| 2,377,906 | 6/1945 | Schraff | 30/349 |
| 2,627,656 | 2/1953 | Richartz | 30/254 |
| 3,750,282 | 8/1973 | Eaton et al. | 30/254 |

FOREIGN PATENT DOCUMENTS

| | | | |
|---|---|---|---|
| 1514169 | 6/1978 | United Kingdom | 30/254 |

*Primary Examiner*—Othell M. Simpson
*Assistant Examiner*—Roscoe V. Parker
*Attorney, Agent, or Firm*—Fred Philpitt

[57] ABSTRACT

Safety scissors wherein the scissor members are composed of a metal member partially embedded in plastic in such a way that a part of the exposed metal serves as a cutting edge and the remaining exposed portion of the metal member bears the sliding friction when the two scissor members are moved relative to each other.

1 Claim, 6 Drawing Figures

PLASTIC SCISSORS WITH METALLIC CUTTING INSERTS

BACKGROUND OF THE INVENTION

The present invention relates to a method of manufacturing a scissors comprising blades made of stainless steel plate punched by a press machine and a synthetic resin in which the blade is buried, and to the resulting scissors.

Conventionally used scissors are generally of a type which are made by casting or forgoing a metal, and such a scissors have flexion characteristic of metal which provides an advantageous point of good cutting quality, but manufacturing cost becomes high and moreover the scissors are not convenient for easy handling due to weight, and are apt to rust easily and polishing by an expert is required to maintain the cutting quality.

On the contrary, scissors made of synthetic resin with a sharp edge of metal has been conceived as an ideal type heretofore, but an appropriate flexion at the sharp edge for actual cutting of sheets of paper, or the like is difficult to obtain, and also the sharp edge is apt to separate from the synthetic resin member, and the manufacturing process becomes more complicated, and as a result of the foregoing drawbacks, no one has ever tried to manufacture them in mass production even if there is an economical advantage.

The present invention is intended to eliminate the foregoing various drawbacks.

SUMMARY OF THE INVENTION

An object of the present invention is to provide a scissors made of synthetic resin with a sharp edge made of metal.

Another object of the present invention is to provide a scissors made of synthetic resin with a blade formed with a depressed portion and resin is penetrated into the depressed portion and is hardened so that the blade will never separate from the synthetic resin body.

A further object of the present invention is to provide a scissors wherein a blade is formed with a depressed portion to impart an appropriate rigidity, and a moderate curve condition can be provided so that when used for a long period of time, the sharp edge maintains its cutting quality, and even if the curve disappears resulting in the deteriorated cutting quality, the user can improve its cutting quality again by bending the sharp edge with hand.

A still further object of the present invention is to provide a scissors made of synthetic resin wherein a projection is provided near a base end portion in the vicinity of a pivot hole to cause a tight slidable contact of both blades which results in a better cutting quality.

A more specific object of the present invention is to provide a method of manufacturing a scissors made of synthetic resin wherein sharp edges only are made of metal.

A particular object of the present invention is to provide a method of manufacturing a scissors made of synthetic resin wherein a depressed portion is formed on the blade, and the blade is positioned accurately on metal mold for injection molding comprised of a male mold and a female mold, and when the male mold and female mold are closed, the depressed portion formed on the blade is pressurized at a plurality of locations and the sharp edge of the blade is urged against the female mold tightly to prevent the synthetic resin from penetrating into the sharp edge, so that the sharp edge of the blade can be accurately exposed.

Another and more particular object of the present invention is to provide a method of manufacturing a scissors wherein a plurality of though holes are formed on the depressed portion and the synthetic resin is penetrated into the depressed portion and is hardened.

DETAILED DESCRIPTION OF THE INVENTION

Ordinary S-shaped scissors are formed by setting a blade 1 made of metal on a mold for injection molding and pressuring the blade with the male mold toward the female mold, causing the sharp edge of the blade to be in proper contact with the female mold, and injecting synthetic resin into the cavity.

Figure 1:
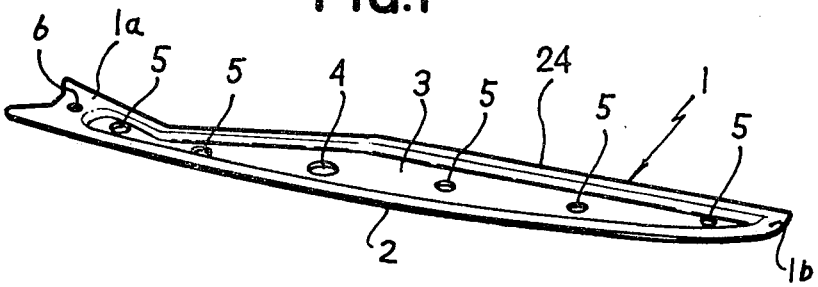
FIG. 1 is a perspective view of a blade.

The inside of the foregoing blade 1 excluding a peripheral edge portion 2 is formed in draw molding to a depth of about 2 millimeters as shown in FIG. 1 to produce a depressed portion 3. A pivot hole 4 is formed in almost the center of the depressed portion 3 and a plurality of through holes 5,5 . . . are formed in the depressed portion, and a standard hole 6 for positioning accurately in the metal mold is formed at a position closer to the base end portion 1*a* of the blade 1. The longitudinal portion of the blade 1 is curved slightly with a large radius of curvature to a side (namely, bulged side, in other words, the reverse side of FIG. 1) to the depressed portion 3. This blade 1 can be produced by punching a stainless steel plate of about 0.3 millimeter thick continuously by means of a transfer press.

Figure 2A:
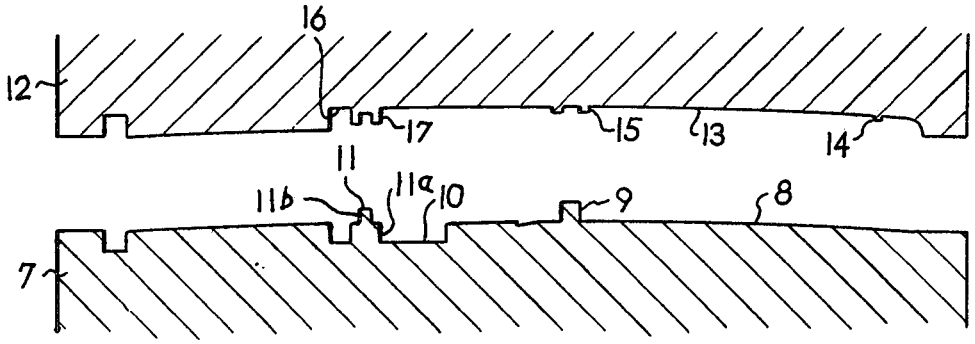
FIGS. 2*a*, 2*b* and 2*c* are vertical cross sections showing the operation of the metal mold for injection molding.
Figure 2B:
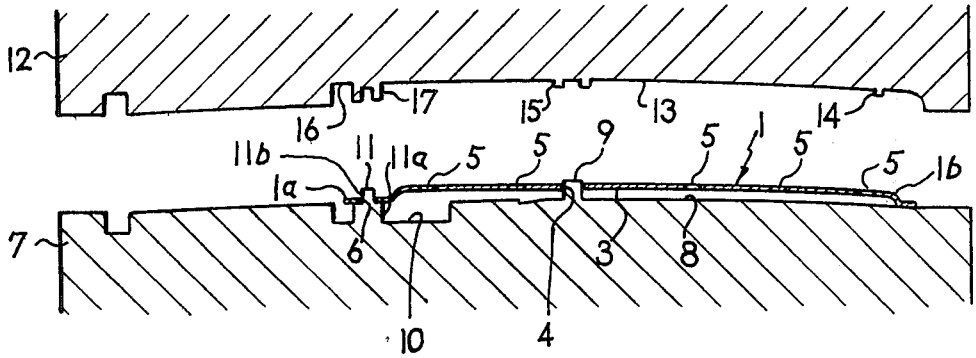
Figure 2C:
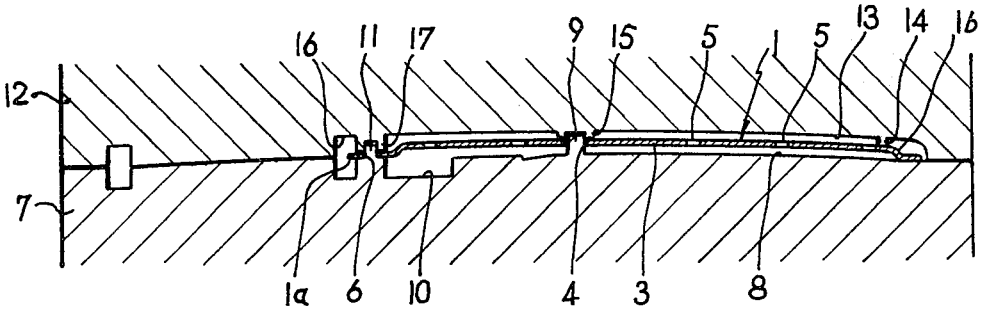

The foregoing injection molding metal mold is comprised of a male mold and a female mold as shown in FIG. 2*a*, and a blade portion forming surface 8 of the female mold 7 is formed in moderate arc-shape along the curve of the blade 1, and a pivot positioning pin 9 that loosely fits to the pivot hole 4 is provided on the blade portion forming surface 8, and a step positioning pin 11 that loosely fits to the standard hole 6 of the blade 1 is projected on a grip portion forming surface 10 of the female mold 7. This step positioning pin 11 is formed with a large diameter portion 11*a* and a small diameter portion 11*b*, and the standard hole 6 of the blade 1 is loosely fitted to the small diameter portion 11*b*. A pressure pin 14 and a cylindrical pivot pressure cylinder 15 that loosely fits with the tip of the pivot positioning pin 9 are respectively projected on a blade portion forming surface 13 of the other male mold 12, and moreover, a standard pressure cylinder 17 that fits loosely with the tip of the step positioning pin 11 (namely, tip of the small diameter portion) is projected on a grip portion forming surface 16 of the male mold 12. However, the pivot hole 4 is fitted with the pivot positioning pin 9 and the standard hole 6 is loosely fitted with the step positioning pin 11 by disposing the blade 1 with its depressed portion 3 downward so as to be arranged on the female mold 7 as shown in FIG. 2*b*, and then both male mold 7 and female mold 12 are closed as shown in FIG. 2*c*, and the blade 1 is pressurized from the bulged surface side by causing the pressure pin 14 to contact the portion closer to the tip portion of the blade 1, and the pivot pressure cylinder 15 is fitted loosely with the pivot positioning pin 9 to pressurize the blade 1 from the bulged surface side, and one surface of the blade 1 is caused to contact the blade portion forming surface 8 tightly, and the standard pressure cylinder 17 is loosely fitted with the step positioning pin 11 to allow the portion closer to the base end portion 1*a* of the blade 1 to apply pressure to the step portion of the step positioning pin 11. Molten ABS resin is injected into the cavity of both metal molds 7 and 12, and the resin forms a blade portion 18 (one side) and a grip portion 19 of the Western style scissors as shown in FIG. 3, and the resin is penetrated into the depressed portion 3 by means of the through holes 5,5 . . . at the blade portion and is hardened.

Figure 3:
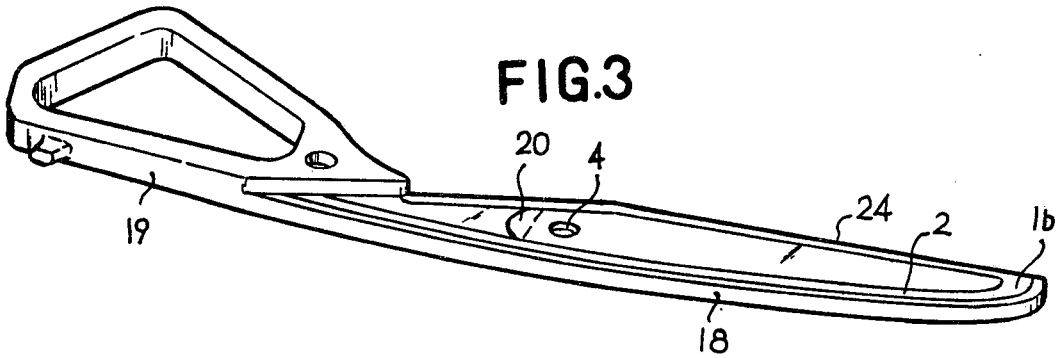
FIG. 3 is a perspective view of Western style scissors (one side)

The female mold 7 is formed in such a way that a hemispherical concave portion of about 0.2 millimeter is formed at a position closer to a base end portion in the vicinity of a pin 9 for pivot positioning, and said portion being the surface of resin which penetrates into and is hardened in the depressed portion 3, and a hemispherical projection 20 of about 0.2 millimeter height is formed in the position closer to the base end portion in the vinicity of the pivot hole 4 as shown in FIG. 3.

Figure 4:
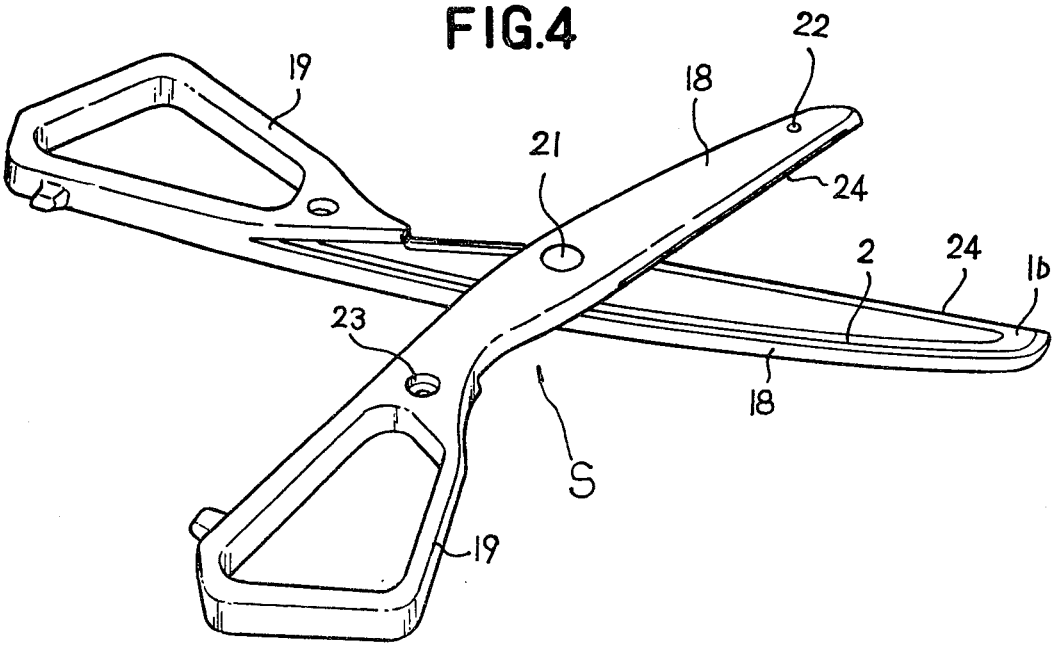
FIG. 4 is a perspective view of the assembled Western style scissors.

Accordingly, the blade 1 is positioned accurately in the female mold 7 by means of the pivot positioning pin 9 and the step positioning pin 11, and when the female mold 12 is closed, the blade 1 is pressurized by the pressure pin 14 and pivot pressure cylinder 15 and standard pressure cylinder 17, and particularly, the pressure is applied on the blade portion forming surface 8 of the male mold 7 at three points so that the resin is prevented from overflowing outside of the depressed portion 3. The molten ABS resin is injected into the cavity of both metal molds 7 and 12, and the resin forms a blade portion 18 and a grip portion 19 of the Western style scissors (one side) as shown in FIG. 3, and furthermore, at the blade portion 18, the resin penetrates into the depressed portion 3 by means of the through hole 5, 5 . . . and is hardened. Component parts of the Western style scissors produced by the foregoing manufacturing method are assembled by riveting the pivot holes as shown in FIG. 4. The sharp edge 24 of the blade 1 is appropriately exposed. In other words, according to the manufacturing method of the present invention, the embedding position of the blade 1 is accurately maintained, and the penetration of the resin is accurately performed so that there is no chance for occurrence of defective parts or product and is suitable for mass production.

We claim:

1. Safety scissors that include two elongated scissor members that are pivotally joined together at a point intermediate their ends so as to divide each scissor member into a gripping section and a cutting section, the improvement being that the cutting section of each scissor member is composed of a metallic member partially embedded in a plastic matrix, said metallic member consisting of an elongated and generally flat piece of metal that includes a recessed interior portion that is surrounded by outwardly extending generally oblong rim portion, one portion of said rim portion serving as the sharp cutting edge for each scissor member, said recessed central portion having a plurality of holes therein, plastics material both filling said recessed portion to a level slightly below the level of said rim portion and extending through said plurality of holes of the area behind said recessed portion so as to form a sturdy support for the entire metallic member, whereby when said scissor members are moved back and forth relative to each other the only portions which come into direct sliding contact are the generally oblong rim portions.

* * * * *